US005670974A

United States Patent [19]

Ohba et al.

[11] Patent Number: 5,670,974

[45] Date of Patent: Sep. 23, 1997

[54] ENERGY RECOVERY DRIVER FOR A DOT MATRIX AC PLASMA DISPLAY PANEL WITH A PARALLEL RESONANT CIRCUIT ALLOWING POWER REDUCTION

[75] Inventors: Masataka Ohba; Yoshio Sano, both of Tokyo, Japan

[73] Assignee: NEC Corporation, Tokyo, Japan

[21] Appl. No.: 534,211

[22] Filed: Sep. 26, 1995

[30] Foreign Application Priority Data

Sep. 28, 1994 [JP] Japan ..... 6-233351
Mar. 1, 1995 [JP] Japan ..... 7-041536

[51] Int. Cl.[6] ..... G09G 3/28

[52] U.S. Cl. ..... 345/60; 345/68; 345/66; 315/169.4

[58] Field of Search ..... 345/60, 68, 62–63, 345/65, 67, 76; 315/169.3, 169.4

[56] References Cited

U.S. PATENT DOCUMENTS

| | | | |
|---|---|---|---|
| 4,070,663 | 1/1978 | Kanatani et al. | 345/76 |
| 4,707,692 | 11/1987 | Higgins et al. | 315/169.3 |
| 4,866,349 | 9/1989 | Weber et al. | 315/169.3 |
| 5,081,400 | 1/1992 | Weber et al. | 315/169.4 |
| 5,107,182 | 4/1992 | Sano et al. | 315/169.4 |
| 5,126,727 | 6/1992 | Asars | 345/76 |
| 5,227,696 | 7/1993 | Asars | 345/76 |
| 5,438,290 | 8/1995 | Tanka | 315/169.4 |
| 5,528,256 | 6/1996 | Erhart et al. | 345/211 |
| 5,535,085 | 7/1996 | Tanaka et al. | 361/58 |
| 5,559,402 | 9/1996 | Corrigan, III | 315/169.3 |

FOREIGN PATENT DOCUMENTS

| | | |
|---|---|---|
| 52-95156 | 8/1977 | Japan . |
| 62-192798 | 9/1986 | Japan . |

OTHER PUBLICATIONS

"Energy Recovery Sustain Circuit for the AC Plasma Display", L.F. Weber and M.B. Wood, *SID 87 Digest* pp. 92–95.

*Primary Examiner*—Mark R. Powell
*Assistant Examiner*—Martin Loui
*Attorney, Agent, or Firm*—Sughrue, Mion, Zinn, Macpeak and Seas.

[57] ABSTRACT

The plasma display panel driver circuit disclosed includes a panel inter-electrode capacitor, a charging/discharging circuit, and a voltage clamp circuit. The panel inter-electrode capacitor is provided between scanning and sustain electrodes of a panel. The charging/discharging circuit is connected in parallel with the panel inter-electrode capacitor and formed by a combination of a coil, FET switches and reverse current blocking diodes. The voltage clamp circuit includes four switches connected to terminals of the panel inter-electrode capacitor. The panel inter-electrode capacitor, together with a series circuit of the coil and the FET switches, forms a parallel resonance circuit. The panel inter-electrode capacitor 40 is repeatedly charged and discharged through the control of the switches with switch drive inputs. In the driving of a plasma display panel, ineffective power is reduced when charging and discharging the panel inter-electrode capacitor.

8 Claims, 8 Drawing Sheets

ENERGY RECOVERY DRIVER FOR A DOT MATRIX AC PLASMA DISPLAY PANEL WITH A PARALLEL RESONANT CIRCUIT ALLOWING POWER REDUCTION

BACKGROUND OF THE INVENTION (1) Field of the Invention

The present invention relates to a plasma display panel driver circuit, and more particularly to a driver circuit for a dot matrix AC plasma display panel of memory type used for personal computers, office work stations, wall-hanging television sets and so forth.

(2) Description of the Related Art

A prior art plasma display panel has a structure with scanning electrodes and column electrodes provided in a matrix array between two insulating substrates such that pixel areas are formed at the intersections of the arrayed electrodes.

An example of the prior art plasma display panel is shown in FIGS. 1A and 1B in a plan view and a sectional view taken along line 1B—1B in FIG. 1A, respectively. As shown, the plasma display panel 20 comprises a first and a second insulating substrate 21 and 22 both made of glass, transparent sustain and scanning electrodes 16*a* and 16*b* formed alternatively on the first insulating substrate 21, metal electrodes 16*c* formed on these sustain and scanning electrodes 16*a* and 16*b* for supplying sufficient currents thereto, column electrodes 17 formed on the second insulating substrate 22 so as to extend at right angles to the sustain and scanning electrodes 16*a* and 16*b*, an insulating layer 23*a* covering the sustain, scanning and metal electrodes 16*a* to 16*c*, an insulating layer 23*b* covering the column electrodes 17, partitioning walls 18 for securing discharging gas spaces 26 filled with discharging gas, such as helium (He) or xenon (Xe), and defining pixels 19, a phosphor screen 24 formed on the insulating layer 23*b* of the second insulating substrate 22 and serving to convert the ultraviolet radiation generated with the discharge of the discharging gas into visible light, and a protective layer 25 of magnesium oxide (MgO) or the like formed on the insulating layer 23*a* of the first insulating substrate 21 for protecting the insulating layer 23*a* from the discharging. In this panel 20, the pixels 19 are defined by the vertical and horizontal partitioning walls 18. By providing the phosphor screen 24 with three colors for each pixel 19, a color plasma display can be obtained. In FIG. 1B, the display may be made either on the upper or lower surface. In this case, the display is preferably made of the lower surface.

FIG. 2 is a plan view showing a plasma display panel with the electrode arrangement as shown in FIGS. 1A and 1B. FIG. 2 illustrating only the electrodes of the plasma display panel 20 shows that the sustain electrodes 16*a* ($C_1$, $C_2$, . . . , $C_m$) and scanning electrodes 16*b* ($S_1$, $S_2$, . . . , $S_m$) on one hand and the column electrodes 17 ($D_1$, . . . , $D_{n-1}$ and $D_2$, . . . ,$D_n$) on the other hand cross one another between the first and second insulating substrates 21 and 22 such that the pixels 19 are formed at the intersections. The first and second insulating substrates 21 and 22 are sealed together along a seal 27. The seal 27 is gas-tight, and a discharging gas is sealed in it.

For write discharging, such plasma display panel is driven by applying scanning pulses on the scanning electrodes 16*b* and applying data pulses on the column electrodes 17 at the same timings. Afterwards, sustain discharging is sustained by the sustain pulses applied alternately on a sustain electrode 16*a* (for instance $C_1$) and an adjacent scanning electrode 16*b* (for instance $S_1$). At this time, emission of ultraviolet radiation is caused by the discharging gas. As a result, the phosphor screen (24 in FIG. 1B) is excited to emit visible light, whereby desired light emission display is obtained. The discharging may be stopped by merely applying an erase pulse, which is lower in voltage than the sustain pulse or has a very small pulse width, between the sustain electrode 16*a* and scanning electrode 16*b*.

In the AC plasma display panel, however, a dielectric layer exists between surface discharging electrodes and also between opposed discharging electrodes, and therefore capacitors are formed. In other words, such a panel has a high capacitance although not so high as that of an electroluminescence (EL) panel. In this case, when applying a sustain pulse on electrodes for charging and discharging inter-electrode capacitor, the energy P supplied from a power source is $$P=C_P\times VS^2 \quad (1)$$

where $C_P$ is the panel capacitance, and VS is the source voltage. Thus, the energy P that is supplied from the power supply in the rise timing is the sum of the resistive loss $(1/2)C_P\times VS^2$ and energy $(1/2)C_P\times VS^2$ used for charging the panel capacitor. The energy that is used in the fall timing for discharging the panel capacitor is the resistive loss $(1/2)C_P\times VS^2$.

In the usual driver circuit, the energy P supplied from the power supply, given by the equation (1) above, is all consumed, i.e., lost, for each pulse across the switching element resistance and panel resistance, and it has no bearing on the discharging at all. The ineffective power P' which has no bearing on the discharging and is consumed during the charging and discharging of the panel capacitance $C_P$ is $P'=P\times f=C_P\times VS^2\times f$ where f is the drive frequency at the time of the actual driving.

Therefore, in the driving of large size panel, the panel capacitance $C_P$ is increased with the panel size increase, thus increasing the ineffective power loss. This means that unlike the small size panel the increase of the integrity of consumed power can no longer be ignored. With the large size panel, a power supply of a higher load capacitance is necessary, and the power supply circuit itself is increased in size. Thus, increasing the panel size allows increased effect which is obtainable by adopting a plasma display panel electrode driver circuit which is capable of reducing the power consumption.

Such plasma display panel electrode driver circuits with reduced power consumption are disclosed in, for instance, Japanese Patent Application Kokai Publication No. Sho 52-95156, Japanese Patent Application Kokai Publication No. Sho 62-192798 and U.S. patent application No. 911396 filed on Sep. 25, 1986.

FIG. 3 is a circuit diagram showing an example of the plasma display panel driver circuit as mentioned above. As shown, the driver circuit comprises a scanning electrode side driver circuit section 37 and a sustain electrode side driver circuit section 38 having the same structure as the scanning electrode side driver circuit section 37. The two driver circuit sections 37 and 38 are coupled to each other by a panel inter-electrode capacitor 40. Here, the construction and operation of only the scanning electrode side driver circuit section 37 will be described.

In the scanning electrode side driver circuit section 37, a coil 34 is connected to scanning electrode point (point A) of the panel. (In the sustain electrode side driver circuit section 38, the coil 34 is connected to the sustain electrode point (point B)). Four FET switches 30, 32, 35 and 36 are connected to the ends of the coil 34. A charge recovery capacitor 29 is connected commonly to one end of each of the two FET switches 30 and 32. Designated at 28, 31 and 33 are diodes.

In this scanning electrode side driver circuit section 37, a series resonance is caused with the coil 34 and the panel capacitor 40, and the panel capacitor 40 is charged and discharged during one half the resonance period. Meanwhile, a voltage of about one half the value of the voltage VS with which to charge the panel capacitor 40 is applied externally, whereby energy used when charging and discharging the panel capacitor 40 with a single scanning electrode pulse (or single sustain electrode pulse in the sustain electrode side driver circuit section 38) is recovered to the capacitor 29 so as to be used when charging the panel capacitor 40 with the next scanning electrode pulse, thus reducing power that is newly supplied from the source line VS.

FIG. 4 is a pulse waveform chart for describing the prior art panel driving. Waveform A is of the scanning electrode pulse at point A in the FIG. 3 scanning electrode side driver circuit section 37. Waveform B is of the sustain electrode pulse at point B in the FIG. 3 sustain electrode side driver circuit section 38. Waveform C is a resultant waveform produced from the scanning electrode pulse at point A and sustain electrode pulse at point B to facilitate the understanding of the operation between the surface discharging electrodes. This waveform C is clamped to be at zero potential during a period of absence of pulse while the voltage is changed between +VS and −VS. Time tf1 is the pulse fall time, and time tr1 is the pulse rise time.

The power loss P" in one cycle in the panel capacitor 40 of the above scanning electrode side driver circuit section 37 is given as $$P''=\{(tr1\times R)/(4\times L)\}\times C_P\times VS^2 \quad (2)$$

where tr1 is the rise time of the scanning electrode pulse at point A (or sustain electrode pulse at point B), R is the series resistance of the switching element 30 or 32 in the driver circuit section 37 and the panel, and L is the inductance of the coil 34.

It will be seen that compared to the driver circuit based on the equation (1) where the above charge recovery is not made, the power loss is less by an amount of (tr1×R)/(4×L).

The rise and fall times tr1 and tf1 of each pulse are related to the inductance L of the coil 34 and the capacitance $C_P$ of the panel capacitor 40 as $$tr1=tf1=\pi\times\{(L\times C_P)^{1/2}\} \quad (3)$$

Substituting the equation (3) into the equation (2), $$P''=(\pi/4)\times R\times\{(C_P/L)^{1/2}\}\times C_P\times VS^2 \quad (4)$$

Thus, the loss is the less the higher the inductance L of the coil 34.

In the above prior art plasma display panel driver circuit, both the scanning and sustain electrodes of the plasma display panel require independent circuits. Besides, with an increase of the number of drive electrodes with increasing panel size, the number of necessary circuits is increased thus increasing the total number of parts involved.

Particularly, the coil for resonance is required to have excellent frequency characteristics because of its operation at as high frequency as nearly 1 MHz and also allow sufficient DC superimposition characteristic because of the flow of a large peak current when charging and discharging the panel capacitor. For these reasons, a large size air core coil is used as the resonance coil. In the actual circuit, however, the air core coil is large in size and occupies considerable part space.

Such a panel driver circuit has a drawback that the charge recovery capacitor is an electrolytic capacitor and thus has high capacitance so that, at the time of the start, it takes considerable time until the steady state is reached. In other words, at the time of the start of the power source, there is no charge, and therefore a considerable time is taken until one half (VS/2) of the voltage VS for the panel capacitor to be charged by the drive voltage is reached. For early stabilization of the operation of the driver circuit, therefore, it is necessary to provide a separate power supply system for externally supplying the voltage of VS/2 or provide a starting circuit which separately supplies kick pulse to the charge recovery capacitor.

SUMMARY OF THE INVENTION

An object of the present invention is to provide a plasma display panel driver circuit, which can reduce unnecessary or ineffective power for energy saving and can be realized with a reduced number of parts.

According to one aspect of the invention, there is provided a plasma display panel driver circuit comprising:

a panel inter-electrode capacitor provided between scanning and sustain electrodes of a panel;

a charging/discharging circuit connected in parallel with the panel inter-electrode capacitor and formed by a combination of a coil and a plurality of switches, the charging/discharging circuit serving to recharge the panel inter-electrode capacitor in an opposite polarity with a resonant current generated at the time of the discharging of the panel inter-electrode capacitor; and a first to a fourth switch provided in a voltage clamp circuit for clamping a terminal voltage across the panel inter-electrode capacitor to the power source voltage level and to the opposite polarity value thereof, the first and third switches being respectively connected between one of two terminals of the panel inter-electrode capacitor and power source terminals, and the second and fourth switches being respectively connected between the other of the terminals of the panel inter-electrode capacitor and the power source terminals, the panel inter-electrode capacitor, together with the charging/discharging circuit, forming a parallel resonant circuit. According to the invention, a parallel resonance circuit is formed by a charging/discharging circuit, which includes a coil, FET switches and reverse current blocking diodes, and a panel capacitor in parallel with the charging/discharging circuit. Further, four switches that are connected to a power source line or to a grounding line, are connected to the opposite terminals of the panel capacitor. Whenever the panel capacitor is charged and discharged, a resonance is brought about by the parallel resonance circuit, whereby charge used for the charging of the panel is directly recovered by the panel itself to be used for the next charging and discharging. With this arrangement, the power supplied from the power source line for charging and discharging the panel is reduced, thus allowing reduction of power consumption required for driving the panel.

Further, according to the invention the opposite terminals of the panel capacitor are not directly connected to a power source line or to a grounding line, and the driver circuit is operated with double the amplitude of the source voltage. Thus, between scanning electrode and sustain electrode, the driver circuit can operate only with a single circuit, and it is possible to reduce the number of parts. Further, only a single power source line system is necessary, and no particular starting circuit is required.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 5:
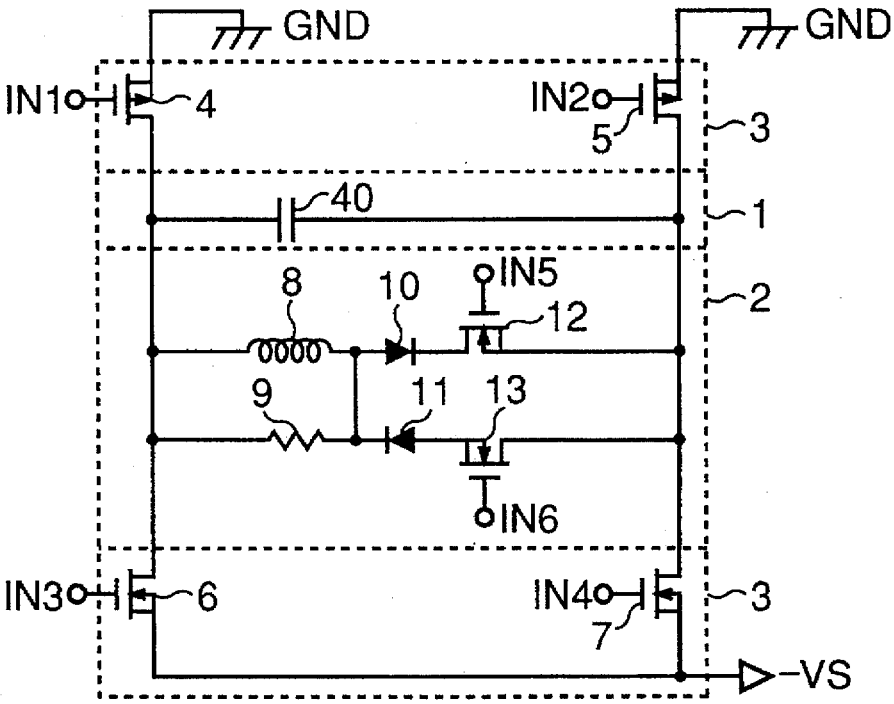
FIG. 5 is a circuit diagram showing an embodiment of the plasma display panel driver circuit according to the invention.

Now, preferred embodiments of the invention will be described with reference to the drawings. FIG. 5 is a circuit diagram showing an embodiment of the plasma display panel driver circuit according to the invention. As shown in FIG. 5, in this embodiment, the capacitance between scanning electrode and sustain electrode of the plasma display panel 1 is shown as panel capacitor 40, and a charging/discharging circuit 2 and a voltage clamp circuit 3 are provided in parallel with the panel capacitor 40. Particularly, the charging/discharging circuit 2 is formed by combining a coil 8, which is connected in parallel with the panel capacitor 40 of the panel 1 and can be charged again to the opposite polarity by a resonant current generated when the panel capacitor 40 is discharged, and two switches 12 and 13. The switches 12 and 13 form a bi-directional switch with respect to the coil 8. More specifically, the switches 12 and 13 are N-channel FETs controlled by different switch drive inputs IN5 and IN6 supplied to their respective gates, and they are connected in series with respective reverse current blocking diodes 10 and 11, these series circuits being connected to one side of the panel capacitor 40 in the panel 1. To the other side of the panel capacitor 40 is connected one end of a parallel circuit having the coil 8 and a resistor 9. To the other end of the parallel circuit, the other terminals of the diodes 10 and 11 are connected commonly. The panel capacitor 40 of the panel 1 and the charging/discharging circuit 2 form a parallel resonance circuit.

The voltage clamp circuit 3 includes a first to a fourth switch 4, 5, 6 and 7, of which first and third switches 4 and 6 are respectively connected between one of two terminals of the panel capacitor 40 and power source terminals GND and −VS while the second and fourth switches 5 and 7 are respectively connected between the other of the terminals of the panel capacitor 40 and the power source terminals GND and −VS. The switches 4 and 5 are P-channel FETs, and switches 6 and 7 are N-channel FETs, the switches 4, 6 and switches 5, 7 forming the CMOS type circuit structures, respectively. The switches 4 to 7 are controlled by different switch drive inputs IN1 to IN4 supplied to their gates. The voltage clamp circuit 3 has a function of clamping the terminal voltage across the panel capacitor 40 to the source voltage (−VS) and to the opposite polarity value (VS) of the source voltage.

The resistor 9 that is connected in parallel with the coil 8 of the charging/discharging circuit 2 is a damping resistor for preventing waveform fluctuation.

In this embodiment, while causing parallel resonance with the parallel resonance circuit formed by the panel capacitor 40 of the panel 1 and the coil 8 in the charging/discharging circuit 2, the clamping of the panel capacitor 40 is repeated with the operation of the switches 4 to 7, thus reducing the ineffective power.

Figure 6:
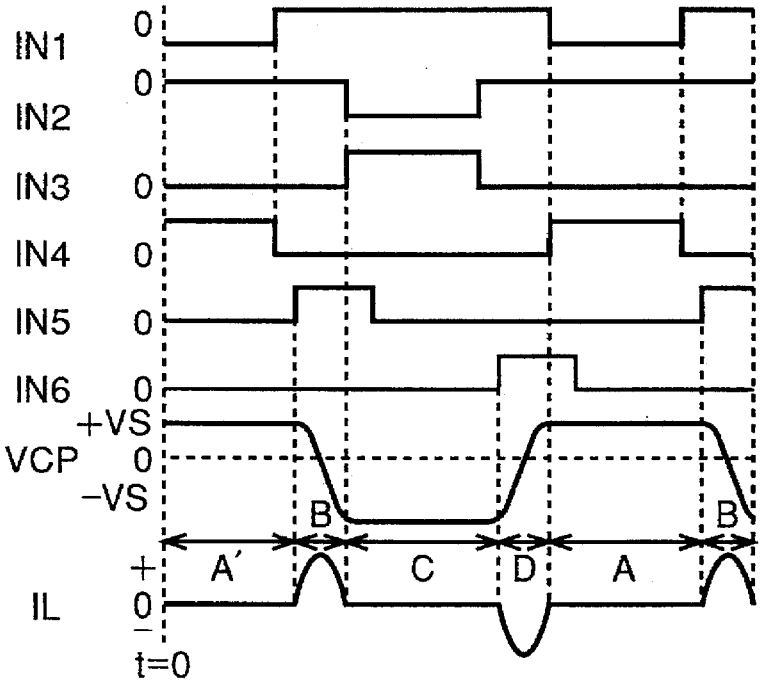
FIG. 6 is a waveform chart showing drive voltage and drive current waveforms in the panel shown in FIG. 5.

FIG. 6 is a waveform chart showing drive voltage and drive current waveforms in the panel shown in FIG. 5. Referring to FIG. 6, waveforms IN1 to IN6 are input waveforms for operating the switches 4 to 7 and FET switches 12 and 13 shown in FIG. 5. Waveform VCP is of the terminal voltage across the panel capacitor 40, and waveform IL is of the current through the coil 8. With respect to the switch drive input waveforms IN1 to IN6 for the six switches, the waveforms IN1 and IN4 and the waveforms IN2 and IN3 are mutually inverse signals. These four different input waveforms may be provided by using inverters.

Specifically, with the switch drive input waveform IN1 supplied as gate-source voltage to the gate of the MOSFET switch 4, the switch 4 is ON during periods A' and A and OFF during periods B, C and D. With the switch drive input waveforms IN2 and IN3 supplied as gate-source voltage to the gates of the MOSFET switches 5 and 6, the switches 5 and 6 are ON during period C and OFF during the other periods A', B, D and A. Likewise, with the switch drive input waveform IN4 supplied as gate-source voltage to the gate of the MOSFET switch 7, the switch 7 is ON during periods A' and A and OFF during periods B, C and D. On the other hand, with the switch drive input waveform IN5 supplied as gate-source voltage to the gate of the MOSFET switch 12, the switch 12 is ON during period B and OFF during the other periods. With the switch drive input waveform IN6 supplied as gate-source voltage to the gate of the MOSFET switch 13, the switch 13 is ON during period D and OFF during the other periods.

One cycle period of this panel driving is from the period A to the period D. However, as shown, the panel capacitor 40 has not been charged at all when the power source is closed (i.e., when t=0), and the operation is varied. Accordingly, the period A' is provided before the period B. The clamping operation will now be described in detail with reference to FIGS. 7A to 7E.

Figure 7A:
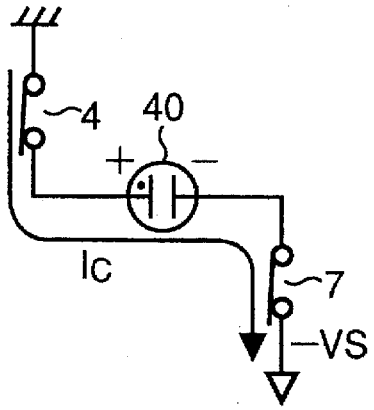
FIGS. 7A to 7E are views for describing operation in individual periods in FIG. 6.

FIGS. 7A to 7E are views for describing the panel driver circuit operation shown in FIG. 6 in the individual periods. As shown in FIG. 7A, in the period A', the panel capacitor 40 of the panel 1 is not charged at all at the start time t=0. Subsequently, with the switches 4 and 7 turning ON, the panel capacitor 40 is connected between the GND and power source (−VS). As a result, charging current Ic is caused to flow with the illustrated polarity to charge the panel capacitor 40. In this operation, the switches 5 and 6 and MOSFET switches 12 and 13 are OFF. Likewise, these switches are hereinafter assumed to be OFF unless otherwise specified.

Figure 7B:
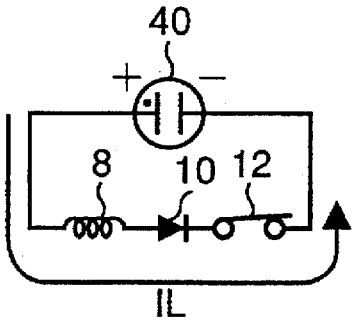

In the subsequent period B as shown in FIG. 7B, the switches 4 and 7 are turned OFF and, after the lapse of a predetermined period of time, the switch 12 is turned ON to cause a discharging current toward the coil 8. At this time, an inverse electromotive force is produced across the coil 8, thus generating the resonant current IL. Subsequently, when the current through the Panel capacitor 40 reaches zero, the voltage VCP on the panel capacitor 40 becomes the maximum inverse voltage (−VS).

Figure 7C:
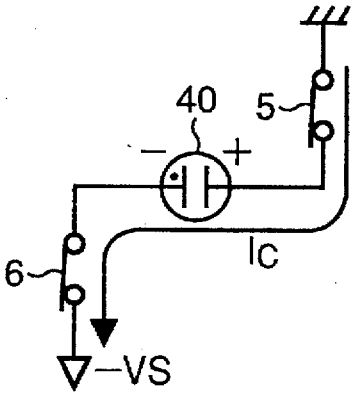

In the subsequent period C as shown in FIG. 7C, with the application of the maximum inverse voltage (−VS) across the panel capacitor 40, the switch 12 is turned OFF while the switches 5 and 6 are turned ON, whereby on the side of the switch 6 the panel capacitor 40 is clamped to the source voltage (−VS). The polarity of the panel capacitor 40 at this time is opposite to that in the period A' shown in FIG. 7A.

Figure 7D:
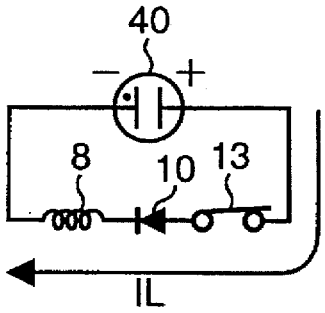

In the subsequent period D as shown in FIG. 7D, the switches 5 and 6 are turned OFF, and after the lapse of a predetermined period of time the switch 13 is turned ON, whereby energy stored in the panel capacitor 40 is discharged through the coil 8, that is, current IL whose polarity is opposite to that in the period B flows. When the potential VCP across the panel capacitor 40 is raised to become zero, the maximum current flows through the coil 8. The panel capacitor 40 is thus charged again to the opposite polarity.

Figure 7E:
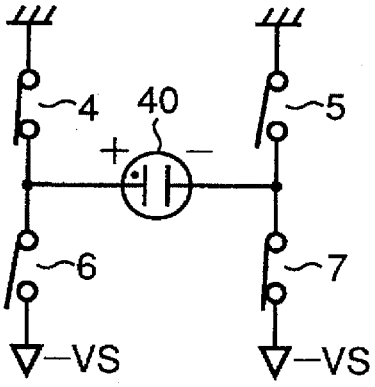

Finally, in the period A as shown in FIG. 7E, when the opposite polarity charging of the panel capacitor 40 with the inverse electromotive force across the coil 8 ends, the switch 13 is turned OFF and the switches 4 and 7 are turned ON, whereby the charge in the panel capacitor 40 is held until the next cycle. Subsequently, the operation from the period A till the period D is repeated.

As described above, in this embodiment, it is possible to reduce the power of charging and discharging of the panel capacitor 40 with the resonance action provided by the panel capacitor 40 and coil 8 and under control of the ON-OFF timings of the individual switches, and to recover most of the ineffective power in a cycle until the next cycle with a reduced number of parts.

Now, the reduction of the power consumption in this embodiment will be considered. First, the power consumption PA is obtained from the product of the source line voltage VS and the in-flowing DC current. Also, the power consumption of the prior art panel driver circuit is obtained as $C_P \times VS^2 \times f$. Then, the ineffective-power recovery factor η is calculated, and it is obtained as $$\eta=\{(1-PA/(C_P\times VS^2\times f)\}\times 100(\%) \quad (5)$$

Figure 1A:
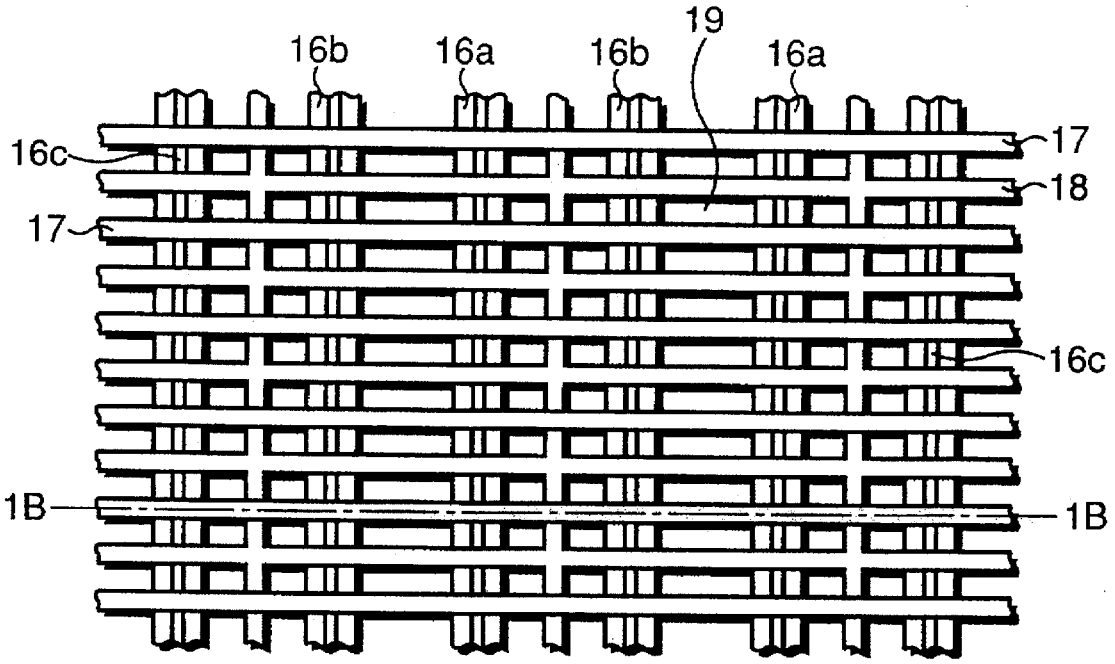
FIG. 1A PRIOR ART
FIGS. 1A and 1B are a plan view and a sectional view taken along line 1B—1B in FIG. 1A, respectively, showing a prior art example of plasma display panel.
Figure 1B:
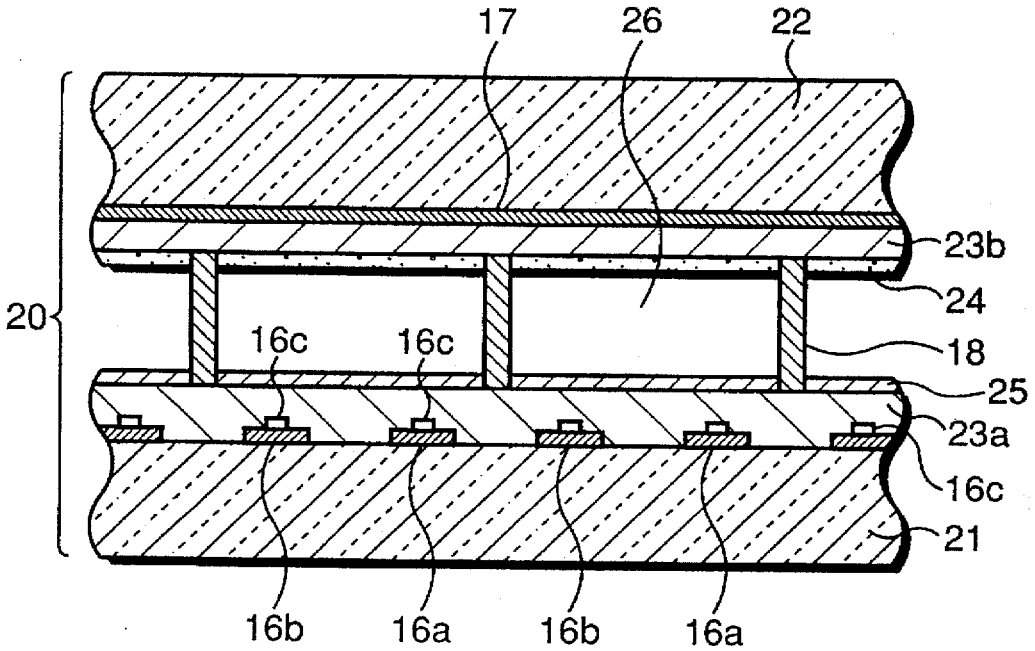
FIG. 1B PRIOR ART
Figure 2:
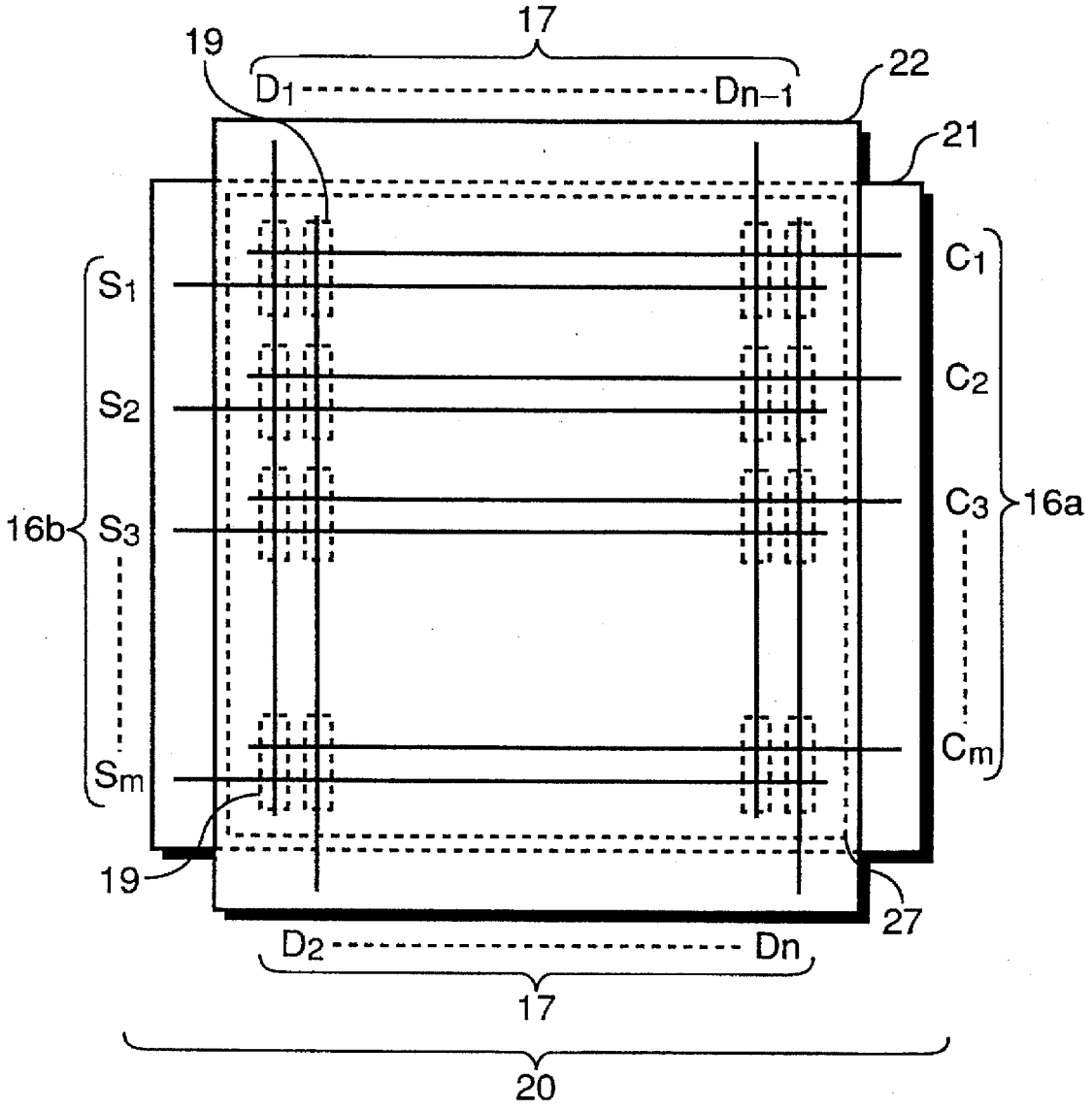
FIG. 2 PRIOR ART
FIG. 2 is a plan view showing a plasma display panel with the electrode arrangement shown in FIGS. 1A and 1B.
Figure 3:
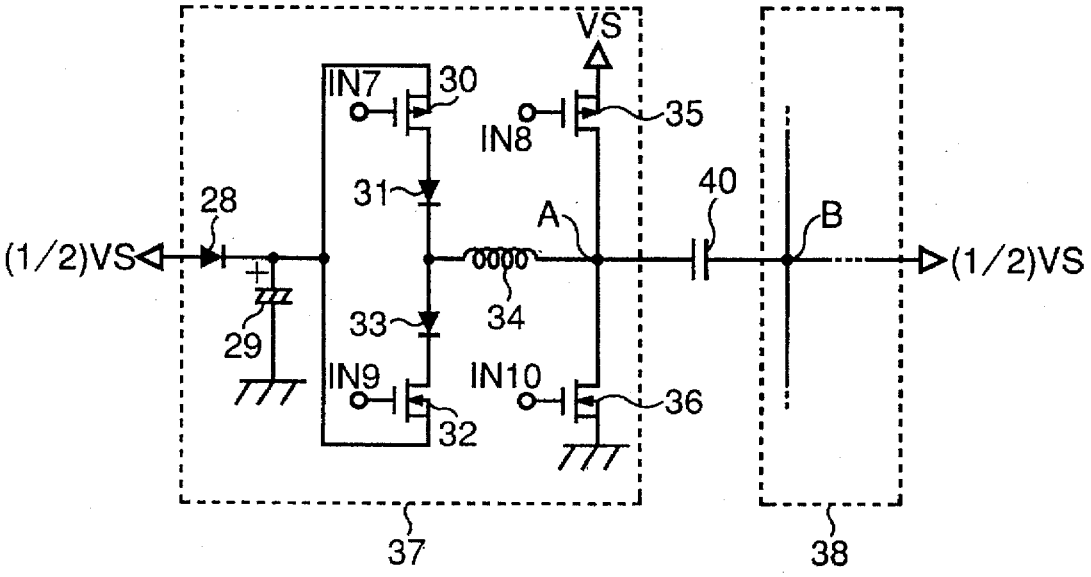
FIG. 3 PRIOR ART
FIG. 3 is a circuit diagram showing a prior art example of plasma display panel driver circuit.

For example, by calculating the recovery factor η as a power consumption reduction effect by setting the coil 8 in FIG. 5 to 1 μH, the source voltage VS to −160 V and the panel capacitance $C_P$ to 4500 pF, a value of 60% or above can be obtained.

Further, by increasing the inductance of the coil 8, the power consumption is reduced from the equation (4), thus improving the recovery factor η as is seen from the equation (5). This is so because increasing inductance of the coil 8 reduces the current to flow when charging and discharging the panel capacitor 40, thus reducing power loss through resistance (R) such as the panel resistance, internal resistance of the coil 8 and ON-resistance of the MOSFETs 12 and 13.

Figure 8:
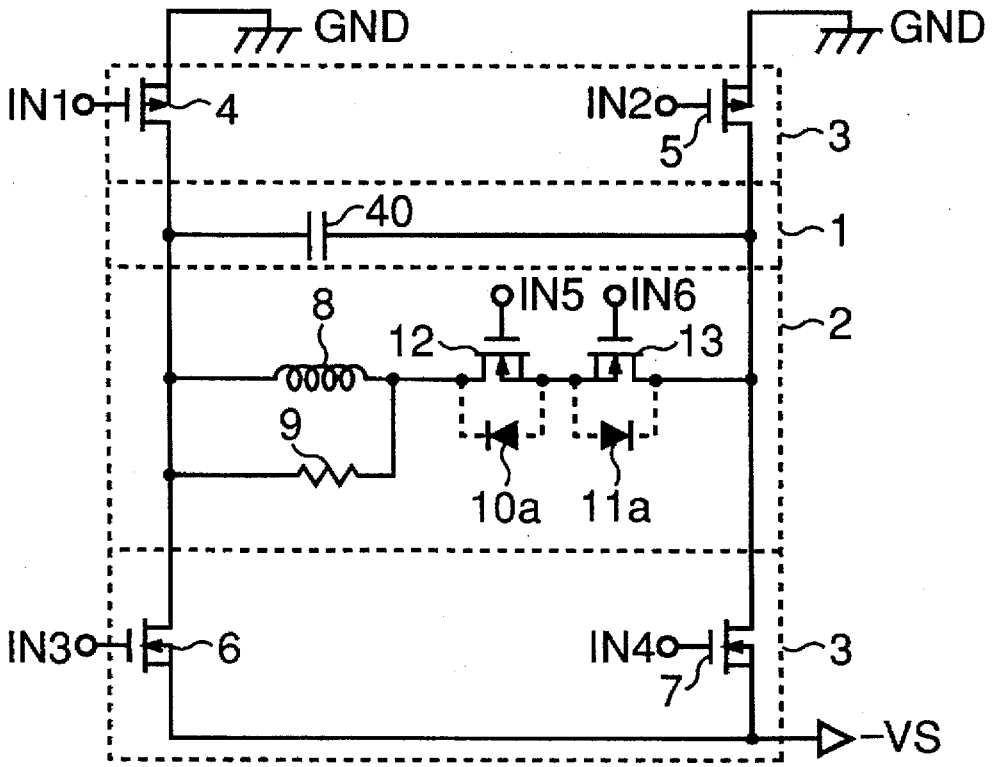
FIG. 8 is a circuit diagram showing a different embodiment of the plasma display panel driver circuit according to the invention.

FIG. 8 is a circuit diagram showing a different embodiment of the plasma display panel driver circuit according to the invention. As shown in FIG. 8, in this embodiment, parts like those in the FIG. 5 embodiment are designated by like reference numerals or symbols. The operation is basically the same. It is the sole difference that in charging/discharging circuit 2 for forming the parallel resonance circuit with respect to the panel capacitor 40 of the panel 1, FET switches 12 and 13 are connected in series. More specifically, in the charging/discharging circuit 2 in parallel with the panel capacitor 40 of the panel 1, the two FET switches 12 and 13 are N-channel FETs in opposite polarity series connection to coil 8. These FET switches 12 and 13 include respective diodes 10*a* and 11*a*, which are in parallel with the FET switches 12 and 13 from the source to the drain. By utilizing these diodes it is possible to dispense with the diodes 10 and 11 shown in FIG. 5 and thus reduce the number of parts.

Again in this embodiment, like the previous embodiment, it is possible to improve the ineffective-power recovery factor η.

Figure 4:
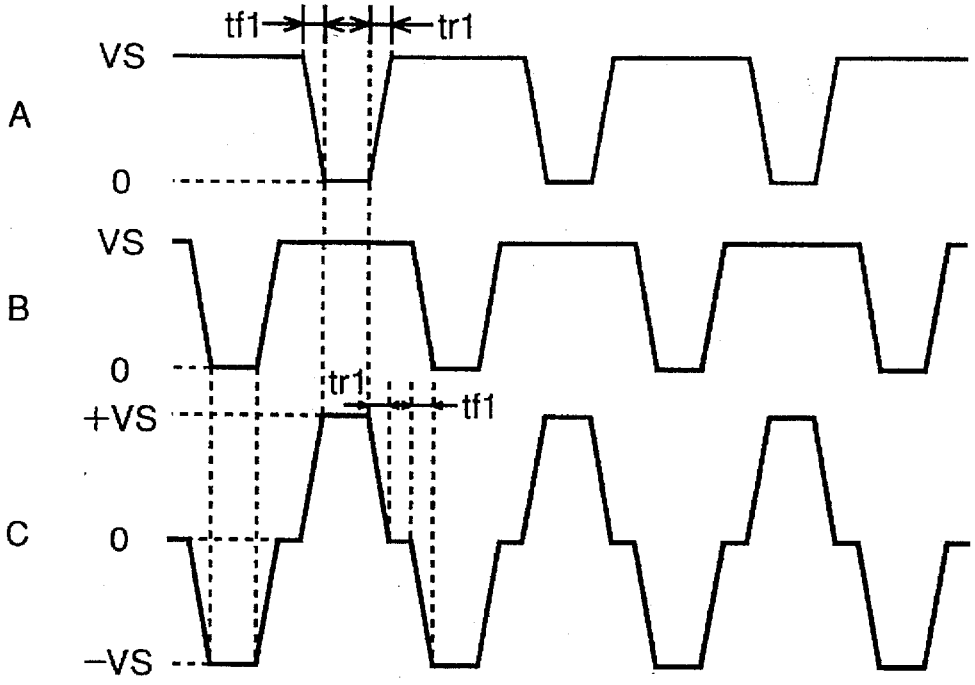
FIG. 4 PRIOR ART
FIG. 4 is a pulse waveform chart for describing the driving of the prior art panel.
Figure 9:
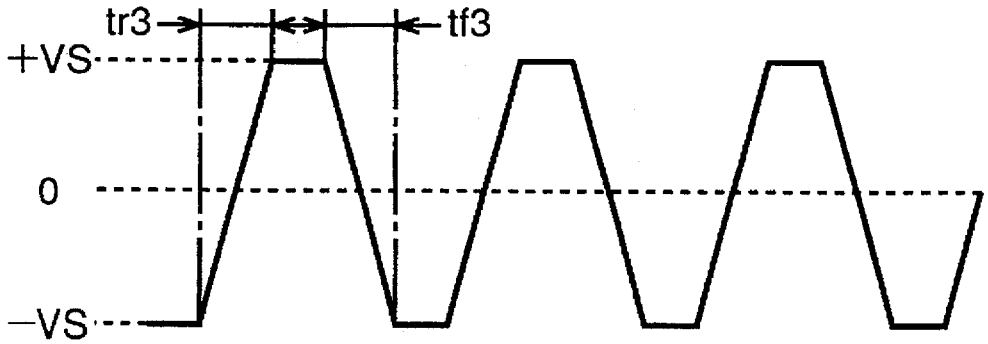
FIG. 9 is a pulse waveform diagram for describing the pulse driving according to the invention.

FIG. 9 is a pulse waveform diagram for describing the panel driving operation according to the invention. This pulse waveform is a sustain pulse waveform which corresponds to the prior art example waveform C shown in FIG. 4 and is observed between the scanning and sustain electrodes. While the above waveform C is clamped to zero potential in the absence of pulse during the period of voltage between +VS and −VS, the waveform in this example is not clamped to zero but is varied between +VS and −VS for clamping. The fall time tf3 of such waveform is set to be equal to the sum of the rise and fall times tr1 and tf1 of the waveform C mentioned above. The fall time tr3 is set likewise.

Figure 10:
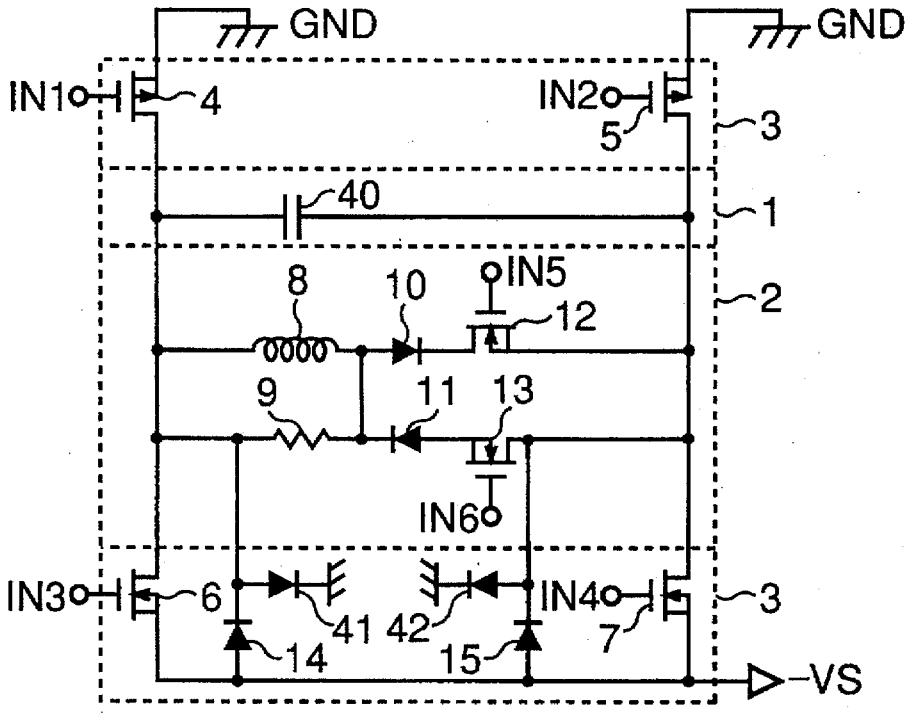
FIG. 10 is a circuit diagram showing a different embodiment of the plasma display panel driver circuit according to the invention.

FIG. 10 shows a further embodiment of the invention. This embodiment is the same as the FIG. 5 embodiment except that diodes 14, 15, 41 and 42 are added. These diodes can be utilized to prevent generation of high frequency parasitic fluctuation of the basic current waveform IL shown in FIG. 6. There is no need of using four diodes as shown in FIG. 10, and an effect is obtainable by using only the diodes 41 and 42. Or an effect is obtainable by using only the diodes 14 and 15.

Figure 11:
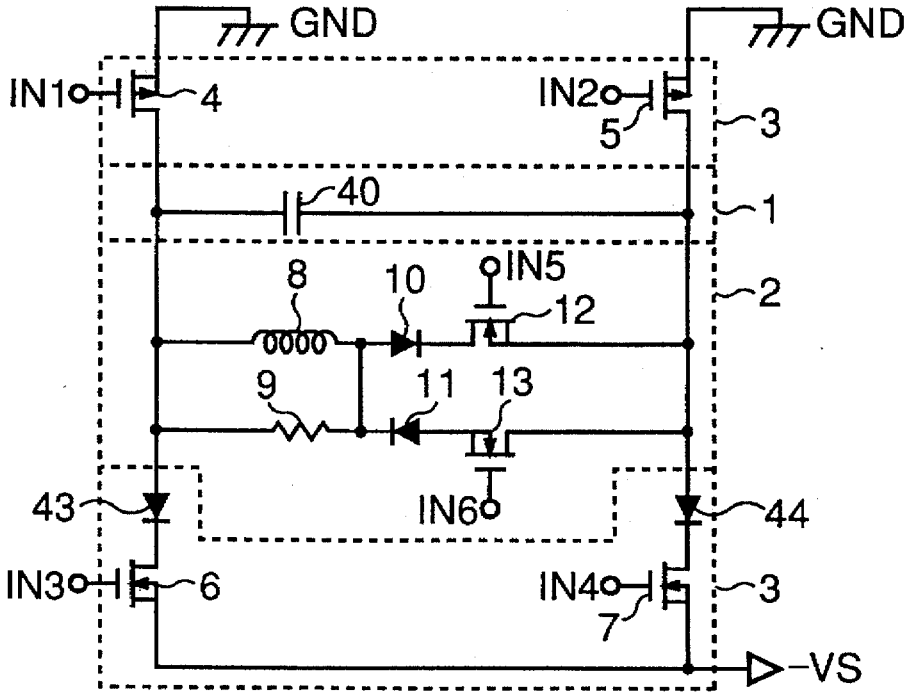
FIG. 11 is a circuit diagram showing a further embodiment of the plasma display panel driver circuit according to the invention.

FIG. 11 shows a further embodiment of the invention. This embodiment is the same as the FIG. 5 embodiment except that diodes 43 and 44 are added. These diodes have a role of preventing reverse current from flowing through the FET switches 6 and 7.

Figure 12:
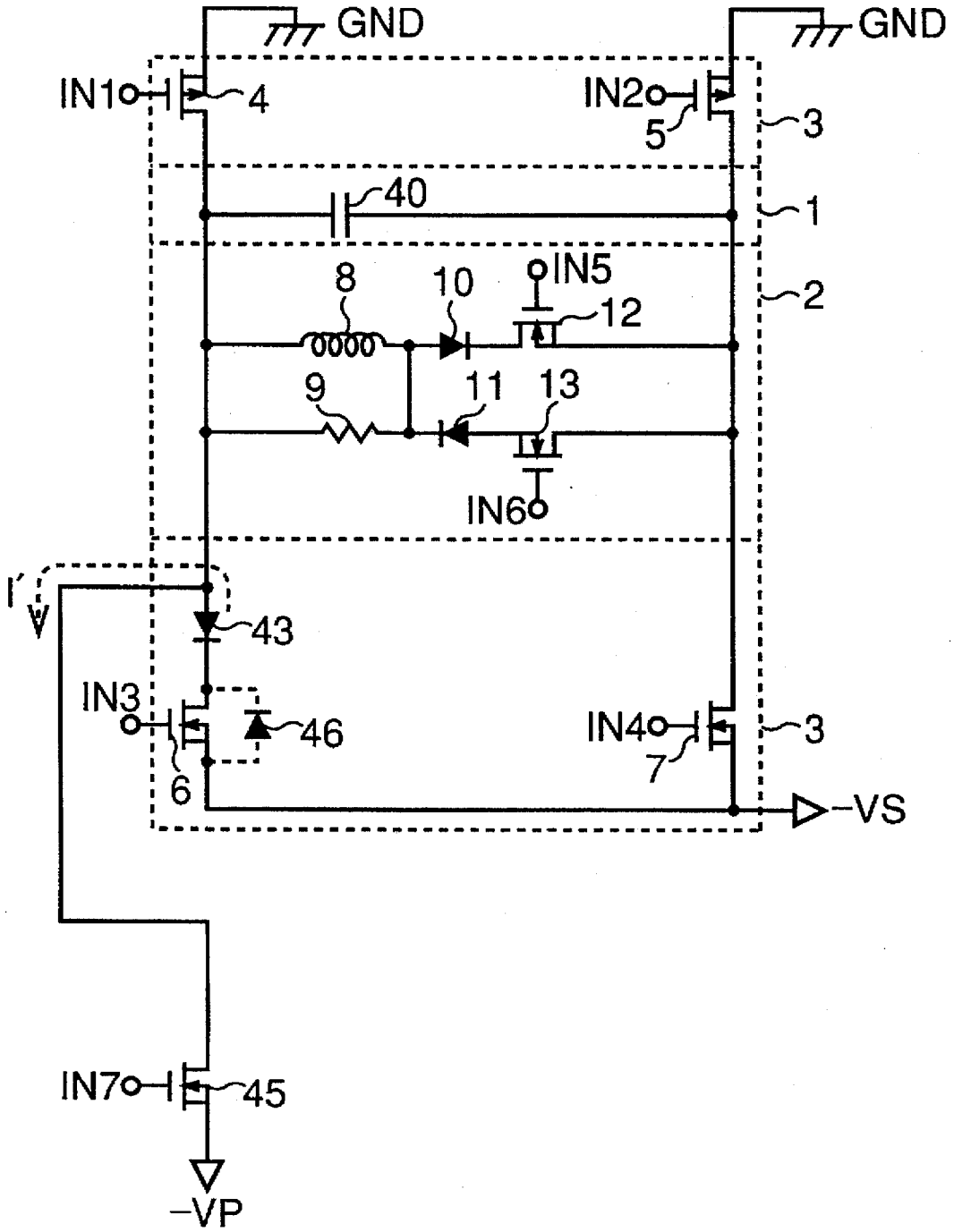
FIG. 12 is a circuit diagram showing an example of application of the embodiment of the plasma display panel driver circuit shown in FIG. 11.

The driving of plasma display panel may be made by using a priming pulse. This is done so for applying a higher voltage than the sustain pulse voltage between the scanning electrode and the sustain electrode to forcibly discharge between these electrodes once so as to provide for write discharging. To this end, as shown in FIG. 12, an FET switch 45 for generating a priming pulse is provided together with FET switch 6. In this case, a diode 43 is provided to prevent a penetration current through the parasitic diode 46 of the FET switch 6. More specifically, unnecessary short-circuit current I' through the parasitic diode 46 of the FET switch 6 toward the FET switch 45, can be prevented when the FET switch 45 is turned ON for generating a priming pulse (with a peak voltage of –VP) which is further negative than the sustain pulse voltage.

While the above embodiments are concerned with FET switches used as current ON-OFF switches, it is of course possible as well to use switch elements other than FETs, for instance bipolar transistors or thyristors.

Further, in the above embodiments the panel capacitor 40 was clamped at the voltage levels of the GND and negative voltage (i.e., voltage value of –VS). However, this is by no means limitative, it is of course possible like the prior art to clamp the capacitor to the GND and positive voltage (i.e., voltage value of VS). In this case, the positive voltage level may be substituted for the GND in the embodiment, and the GND for the negative voltage level of –VS.

As has been described in the foregoing, the plasma display panel driver circuit according to the invention comprises a charging/discharging circuit connected in parallel with panel capacitor and a voltage clamp circuit including four switches, a parallel resonant circuit being formed by the panel capacitor and the charging/discharging circuit. With this structure, the generation of ineffective power not contributing to the light emission in the charging and discharging of the panel capacitor can be suppressed at the time of the application of the sustain pulse, and charge due to the voltage induced by the resonance with the panel capacitor and coil is stored again in the panel itself to be used when charging again the panel capacitor in the next sustain pulse cycle. Thus, it is possible to reduce the power consumption required for the charging and discharging of the panel, that is, it is possible to reduce ineffective power.

Further, in the panel driver circuit according to the invention, the scanning and sustain electrodes of the panel can be driven commonly and further with a single power source system. It is thus possible to simplify the circuit construction and realize the panel driver circuit with a reduced number of parts.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A plasma display panel driver circuit comprising:

a panel inter-electrode capacitor provided between scanning and sustain electrodes of a panel;

a charging/discharging circuit connected in parallel with said panel inter-electrode capacitor and formed by a combination of a coil and two switches, said charging/discharging circuit serving to recharge the panel inter-electrode capacitor in an opposite polarity with a resonant current generated at the time of the discharging of the panel inter-electrode capacitor; and a first to a fourth switch provided in a voltage clamp circuit for clamping a terminal voltage across the panel inter-electrode capacitor to a power source voltage level and to the opposite polarity value thereof, said first and third switches being connected in series between a first power terminal having a ground potential and a second power terminal having a potential different from said ground potential, said second and fourth switches being connected in series between said first power terminal and said second power terminal, and said panel inter-electrode capacitor being connected between a series connection node of said first and third switches and that of said second and fourth switches, said panel inter-electrode capacitor, together with said charging/discharging circuit, forming a parallel resonant circuit.

2. The plasma display panel driver circuit according to claim 1, which further comprises diodes connected in parallel with said third and fourth switches.

3. The plasma display panel driver circuit according to claim 1, in which said two switches constitute a bi-directional switches with respect to said coil.

4. The plasma display panel driver circuit according to claim 1, in which said charging/discharging circuit comprises two series connected circuits connected in parallel with respect to said coil, the series circuits each having an FET switch and a diode in series therewith.

5. The plasma display panel driver circuit according to claim 1, in which said charging/discharging circuit comprises two FET switches connected in opposite polarity series with respect to said coil.

6. The plasma display panel driver circuit according to claim 1, in which two each of said first to fourth switches connected to each terminal of said panel inter-electrode capacitor are CMOS transistors.

7. The plasma display panel driver circuit according to claim 1, in which said first to fourth switches in said voltage clamp circuit and said two switches in said charging/discharging circuit, wherein said first to fourth switches and said two switches are respectively controlled by different switch drive inputs repeat the clamping of and charging and discharging of said panel inter-electrode capacitor so that ineffective power is reduced.

8. The plasma display panel driver circuit according to claim which further comprises reverse current blocking diodes connected respectively in series with said third and fourth switches connected to said second power source terminal.

* * * * *